US009758266B2

(12) United States Patent
Taylor

(10) Patent No.: US 9,758,266 B2
(45) **Date of Patent: *Sep. 12, 2017**

(54) FILM DRIVE ASSEMBLY

(71) Applicant: TNA Australia Pty Limited, Lidcombe (AU)

(72) Inventor: Alfred Alexander Taylor, Lugarno (AU)

(73) Assignee: TNA Australia Pty Limited, Lidcombe (AU)

( * ) Notice: Subject to any disclaimer, the term of this patent is extended or adjusted under 35 U.S.C. 154(b) by 452 days.

This patent is subject to a terminal disclaimer.

(21) Appl. No.: 13/693,247

(22) Filed: Dec. 4, 2012

(65) Prior Publication Data

US 2013/0186926 A1 Jul. 25, 2013

(30) Foreign Application Priority Data

Dec. 5, 2011 (AU) ..... 2011905058

(51) Int. Cl.

| | |
|---|---|
| ***B65B 41/00*** | (2006.01) |
| ***B65B 41/16*** | (2006.01) |
| ***B65B 9/20*** | (2012.01) |
| *B65B 9/22* | (2006.01) |

(52) U.S. Cl.

CPC ..... *B65B 41/00* (2013.01); *B65B 9/2021* (2013.01); *B65B 9/2028* (2013.01); *B65B 41/16* (2013.01); *B65B 9/22* (2013.01)

(58) Field of Classification Search

CPC .... B65B 9/10; B65B 9/20; B65B 9/22; B65B 9/2014; B65B 9/2021; B65B 9/2028; B65B 51/26; B65B 41/00; B65B 41/16

USPC ..... 53/551, 389.5; 493/274, 202

See application file for complete search history.

(56) References Cited

U.S. PATENT DOCUMENTS

| | | | |
|---|---|---|---|
| 4,663,917 | A | 5/1987 | Taylor et al. |
| 4,753,336 | A | 6/1988 | Taylor et al. |
| 4,910,943 | A | 3/1990 | Taylor et al. |
| 5,412,927 | A | 5/1995 | Miyazaki |
| 5,622,032 | A | 4/1997 | Ryan |
| 6,655,110 | B2 | 12/2003 | Taylor |
| 7,124,559 | B2 | 10/2006 | Taylor |
| 7,152,387 | B2 | 12/2006 | Taylor |
| 7,159,376 | B2 | 1/2007 | Taylor |
| 7,383,672 | B2 | 6/2008 | Taylor et al. |
| 7,415,809 | B2 | 8/2008 | Taylor |

(Continued)

FOREIGN PATENT DOCUMENTS

| | | |
|---|---|---|
| EP | 2 063 237 A1 | 5/2009 |
| GB | 2416341 A | 1/2006 |

(Continued)

OTHER PUBLICATIONS

Search Report mailed Apr. 8, 2013, from Great Britain Application No. GB1221787.3 (3 pages).

*Primary Examiner* — Thanh Truong
*Assistant Examiner* — Thomas Wittenschlaeger
(74) *Attorney, Agent, or Firm* — Kilpatrick Townsend & Stockton LLP

(57) ABSTRACT

A drive assembly (17) to move tubular bag material past a former and deliver a tubular bag material to a packaging machine. The drive assembly (17) includes a pair of drive belts (6) that are parallel and driven in unison by means of a drive pulley (29) and either pulleys (30, 31).

17 Claims, 2 Drawing Sheets

(56) References Cited

U.S. PATENT DOCUMENTS

| | | | | |
|---|---|---|---|---|
| 7,472,528 | B2 * | 1/2009 | Taylor | 53/551 |
| 7,600,630 | B2 | 10/2009 | Taylor et al. | |
| 2003/0046905 | A1 * | 3/2003 | Kaechele et al. | 53/459 |

FOREIGN PATENT DOCUMENTS

| | | | |
|---|---|---|---|
| JP | 2000-072103 | A | 3/2000 |
| JP | 2004315052 | A | 11/2004 |

* cited by examiner

FILM DRIVE ASSEMBLY

This application claims priority to Australian Patent Application No. 2011905058, filed on Dec. 5, 2011, the disclosure of which is incorporated by reference herein.

FIELD

The present invention relates to film drive assemblies for packaging machines and more particularly but not exclusively to engage tubular bag material to move the tubular bag material past a former shoulder to a packaging machine.

BACKGROUND

Packaging machines receive bag material in tubular form. Product to be packaged is delivered to the interior of the tubular bag material, with the packaging machine then transversely sealing and cutting the tubular bag material to form bags of product. The tubular bag material is formed by a former shoulder, to which packaging film is delivered in strip form. Formers and packaging machines are described in U.S. Pat. Nos. 4,910,943, 5,622,032, 4,663,917, 6,655,110, 7,159,376, 7,600,630, 7,383,672, 4,753,336, 7,124,559, 7,415,809, 7,152,387 and 7,472,528.

The tubular material provided by the former shoulder is longitudinally sealed. This function is performed by heating the tubular bag material along its longitudinally overlapping edges and by applying pressure to the overlapping longitudinal edges.

In order to successfully form the longitudinal seal, the tubular bag material must be heated to a required temperature so that upon pressure being applied the plastic material fuses to form the seal. The temperature of the tubular bag material is raised to the required temperature by the bag material passing a heated backing bar or heating bar.

The bag material is pulled past the former shoulder and delivered to the packaging machine by a film drive assembly. These assemblies have included rollers and belts with drive surfaces from which there extend passages. The passages are subjected to a reduced air pressure so that the bag material is drawn into engagement with the drive surfaces to provide for group frictional engagement between the drive surface and the bag material.

Where drive belts have been employed, the drive belts pass between an upper pulley and a lower pulley, of which one is driven. Manifolds engage the inner surface of the belt, with reduced air pressure being delivered to the manifolds which in turn communicate with the passages through the belt. The manifolds are located adjacent the length of the belt that engages tubular bag material. This length of the belt passes along a generally linear path and is generally upright.

Also located between the pulleys and located adjacent the manifolds is a heating bar that is urged against the longitudinally overlapping portions of the tubular bag material to sealingly secure the longitudinal edge portions together.

A disadvantage of the above discussed drive assemblies is that they occupy considerable longitudinal distance in the direction of travel of the tubular bag material. In particular the disadvantage is the height of the machinery, and the length of tubular bag material above the sealing jaws of the packaging machine.

OBJECT

It is the object of the present invention to overcome or substantially ameliorate at least one of the above disadvantages.

SUMMARY

There is disclosed herein a film drive assembly to engage strip film material to move the material, the drive assembly including:

a loop drive belt having a drive surface to frictionally engage the material, the belt moving along a predetermined path including a generally linear first path portion along which the drive surface engages the belt, the belt having a plurality of passages extending transversely through the belt from said surface;

a manifold to be subjected to a reduced air pressure and communicating with the passages for at least a part of said path portion so that the passages are subjected to a reduced air pressure so that a difference in air pressure across the material urges the material against said surface;

a drive pulley engaged with the belt to cause the belt to move along said path in a predetermined direction;

a plurality of belt engaging devices, with said belt passing between the a first one of engaging devices and said pulley to provide said first path portion, with the devices co-operating to provide a second path portion and a third path portion, with the second and third path portions relative to said first path portion having a direction of extension away from said first path portion.

Preferably, there are two devices including a first device and a second device.

Preferably, the first and second belt engaging devices are pulleys.

Preferably, the second and third portions are linear.

Preferably, the assembly includes a heating bar at said first path portion to heat the bag material and being urged into contact with the bag material.

Preferably, said belt is a first belt, and said assembly includes a second belt, the second belt being generally parallel to the first belt and including a drive surface and a plurality of passages extending transversely of the second belt from the drive surface of the second belt, with the passages of the second belt communicating with the manifold so that the passages of the second belt are also subjected to a reduced air pressure to urge the bag material into engagement with the second belt.

Preferably, the second belt also passes around the drive pulley and first and second belt engaging devices.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 2:
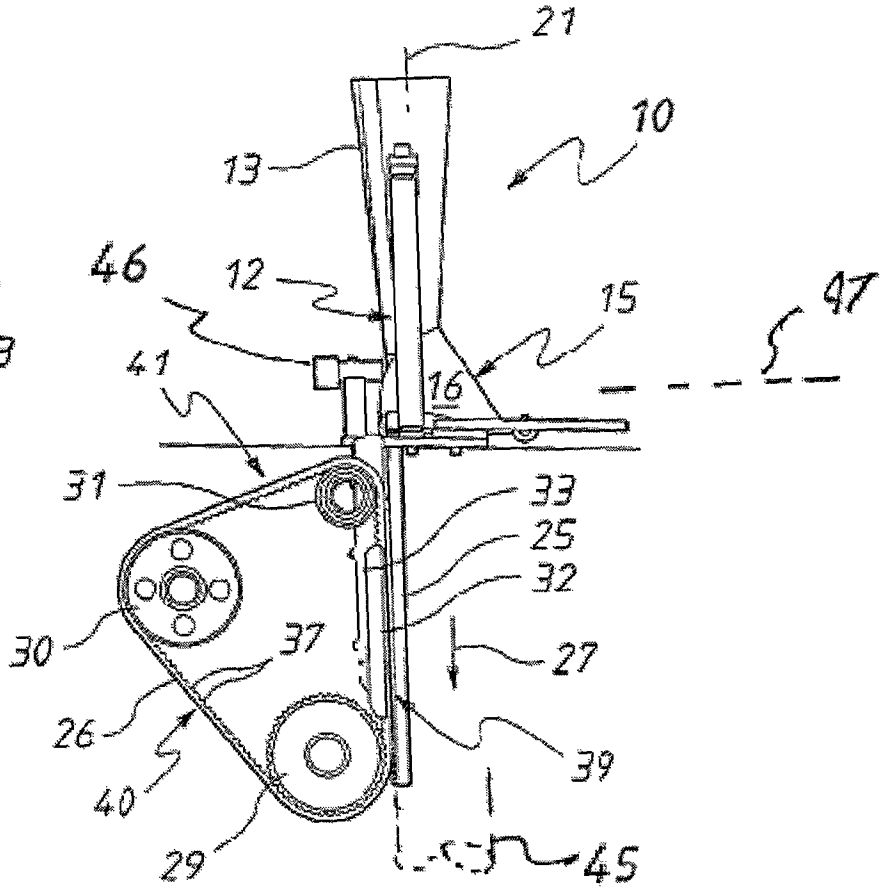
FIG. 2 is schematic side elevation of the former assembly and drive of FIG. 1.
Figure 1:
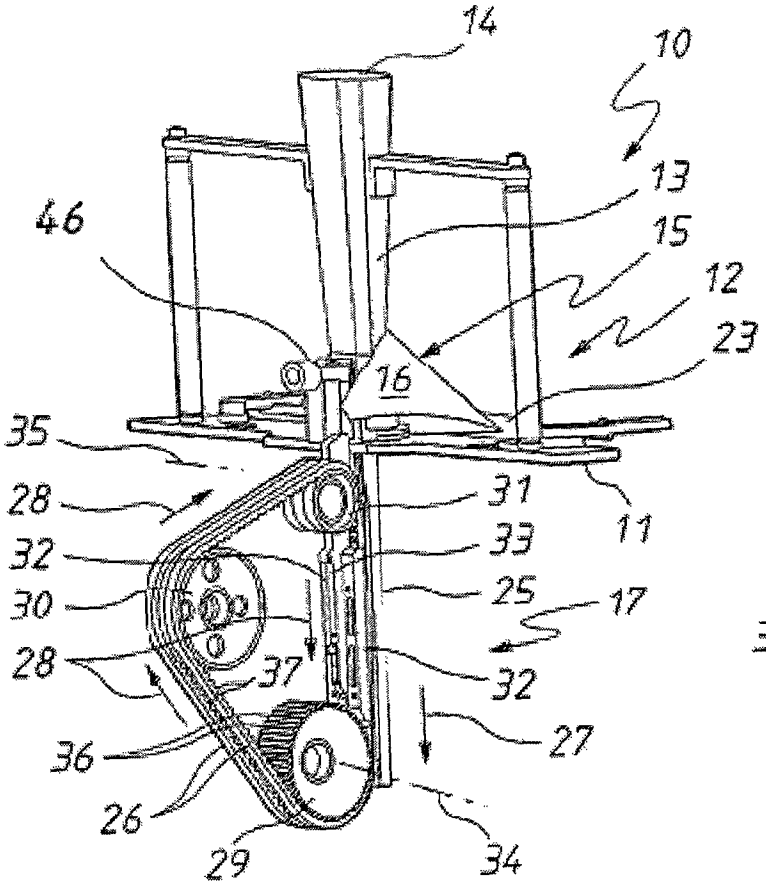
FIG. 1 is a schematic isometric view of a former assembly and a drive to engage tubular bag material to pull the bag material past the former assembly.

In the accompanying drawings there is schematically depicted a former assembly 10. Previous former assemblies as disclosed in U.S. Pat. Nos. 712,459 and 7,415,809.

The former assembly 10 includes a base 11 to which there is attached a frame 12 that supports a sleeve 13. The sleeve 13 encloses a generally upwardly extending passage 14 to which product is delivered in batches from a weighing machine such as that disclosed in U.S. Pat. No. 7,600,630 and European Patent Application 082909573. The sleeve 13 passes through a former shoulder 15 having an external former surface 16 to which strip film material 47 is delivered to be formed into a tubular configuration. Product is delivered to the passage 14 to be delivered to the interior of the tubular bag material 45. A packaging machine, such as that disclosed in U.S. Pat. No. 4,753,336, positioned below the drive assembly 17 transversely seals and cuts the tubular bag material 45 to form bags of product.

The former assembly 10 may include ducting 46 to deliver an inert gas to the interior of the tubular bag material 45.

Figure 6:
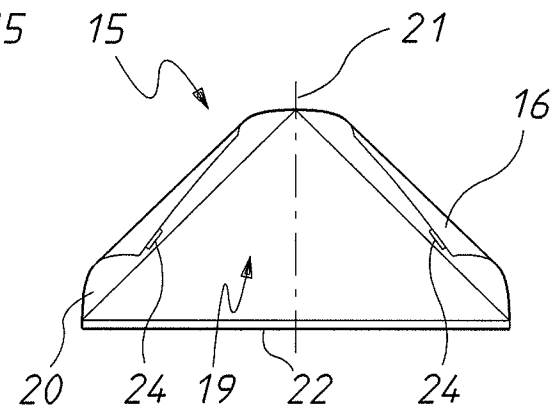
FIG. 6 is a schematic sectioned front elevation of the former shoulder as shown in FIG. 5 sectioned along the line 6-6.
Figure 5:
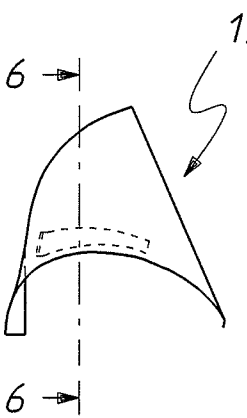
FIG. 5 is a schematic side elevation of the former shoulder of FIG. 3.
Figure 3:
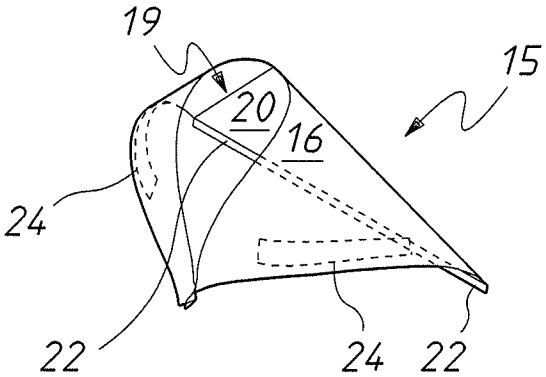
FIG. 3 is a schematic isometric view of a former shoulder of the former assembly of FIGS. 1 and 2.
Figure 4:
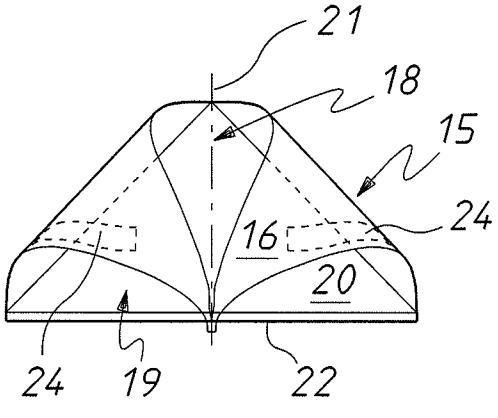
FIG. 4 is a schematic front elevation of the former shoulder of FIG. 3.
Figure 7:
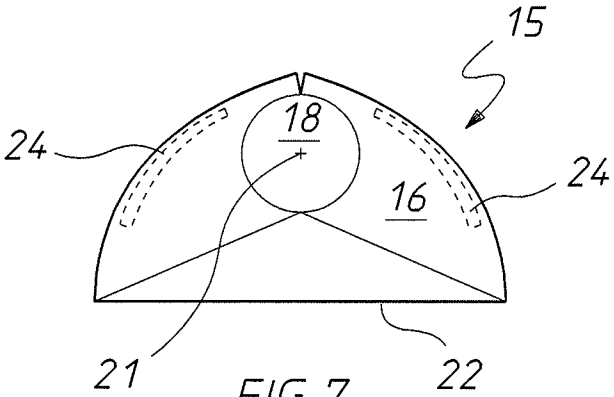
FIG. 7 is a schematic top plan view of the former shoulder of FIG. 3.

The former shoulder 15 is more fully depicted in FIGS. 3 to 7. The shoulder 15 of this embodiment has the external surface 16 surrounding a generally central circular aperture 18 via which product is delivered to the interior of the tubular bag material. The sleeve 13 passes through the aperture 18 so as to project through the internal cavity 19 of the shoulder 15. The cavity 19 is surrounded by the internal surface 20 of the shoulder 15.

In the above described preferred embodiment, the aperture 18 is generally circular. However in other embodiments, the aperture 18 may be generally square or rectangular, depending on the configuration of the bag being formed.

The shoulder 15 is formed from a sheet of stainless steel bent around a generally central upright longitudinal axis 21, with the sheet terminating at a folded rear edge 22. The rear edge 22 is secured to a transverse member 23 of the frame 12. The axis 21 is the central axis of the aperture 18.

Fixed to the internal surface 20 are heaters 24 that heat the external surface 16 over which the film bag material passes so as to be heated. The heaters 24 are located on opposite sides of the aperture 18, in particular the aperture 18 and axis 21 are located between the heaters 24. More particularly the heaters 24 are symmetrically arranged on opposite sides of the axis 21 and extend angularly about the axis 21. Each heater has a transverse width and a longitudinal length greater than the width. Each heater 24 extends longitudinally angularly about the axis 21.

Heating of the tubular bag material 45 as it passes the former shoulder 15 has the advantage of reducing the length of the tubular bag material 45 that needs to be heated by the drive assembly 17. Accordingly the drive assembly 17 can be reduced in height.

The heaters 24 may be electrical resistance heaters, that is the heaters 24 have an electrical resistance so that upon electric power being applied thereto, they are raised in temperature, therefore raising the temperature of the surface 16.

The film bag material passing over the surface 16 is formed into a tubular form with overlapping longitudinal edges. The heaters 24 are located so as to heat the longitudinal edges of the bag material.

Fixed to so as to be supported by the frame 12 is a backing bar 25. The backing bar 25 is located internally of the tubular bag material 45 so that the tubular bag material 45 is located between the backing bar 25 and the drive belts 26. The backing bar 25 may include a heater so that the overlapping longitudinally extending edge portions of the tubular bag material 45 are heated thereby.

The belts 26 engage the tubular bag material 45 and cause the tubular bag material 45 to pass downwardly in the direction 27 past the former shoulder 15 for delivery to a packaging machine below the assembly 17. The packaging machine may be a packaging machine as disclosed in U.S. Pat. No. 4,753,336.

The belts 26 are driven around a loop in the direction 28 by means of a drive pulley 29. The pulley 29 would be connected via shaft to a drive motor. The belts 26 pass about idler pulleys 30 and 31, with the belts 26 passing between the pulleys 29 and 30 along a linear path parallel to the backing bar 25 and axis 21.

Located adjacent the backing bar 25 are vacuum manifolds 32 to which a vacuum is applied. The belts 26 have apertures (not illustrated) that communicate with the vacuum chambers provided by the manifolds 32, with the reduced air pressure being applied to one side of the tubular bag material 45 to urge the tubular bag material 45 into contact with the drive surfaces of the belts 36. The vacuum drive assemblies are shown in U.S. Pat. Nos. 7,124,559 and 4,910,943.

Located between the manifolds 32 is a heating bar 33 that is electrically heated to again aid in raising the temperature of the tubular bag material 45 so that pressures applied to the tubular bag material 45 by the bar 33 and backing bar 25 will cause the longitudinal edge portions of the tubular bag material 45 to be fused so as to be sealingly connected. The bar 33 is urged toward the bar 25 by springs not illustrated.

To drive the belts 26, the pulley 29 is provided with a plurality of drive teeth 36 that engage teeth 37 on the drive surface of the belts 26.

The pulleys 30 and 31 provide belt engaging devices about which the belts 26 pass. In this embodiment, the belt engaging devices are pulleys.

Passing from the pulley 31 to the pulley 29, the belts 26 pass along a first linear path portion 39, while from the pulley 29 to the pulley 30, the belts 26 pass along a second linear path portion 40, while from the pulley 30 to the pulley 31 the belts 26 pass along a third linear path portion 41. The path portions 40 and 41 are inclined to the path portion 39 by acute angles. Accordingly the path portions 40 and 41 have a direction of extension away from the path portion 39. It should be appreciated that in this embodiment there are three pulleys, 29, 30 and 31. However more pulleys may be employed thereby increasing the number of path portions.

An advantage of the above described drive assembly 17 is that the distance between the rotational axes 34 and 35 of the pulleys 29 and 31 is reduced relative to previous machines as it is no longer necessary for the tubular bag material 45 to be heated over an extended length. To provide for this reduced distance between the axes 34 and 35 the further idler pulley 30 is required.

The above described preferred embodiments of the present invention provide the advantage of reducing the overall length of the tubular bag material 45 between the aperture 18 and the packaging machine. It has been found that by reducing this length the product being packaged is maintained in batches having a shorter longitudinal length (a length parallel to the axis 21).

The invention claimed is:

1. In combination, a former shoulder and a film drive assembly to engage strip film material to move the strip film material downwardly past the former shoulder to form tubular bag material having longitudinally extending edge portions forming a longitudinal seal, the film drive assembly comprising:

a loop drive belt having a drive surface to frictionally engage the tubular bag material, the loop drive belt moving along a polygonal path including a first path portion along which the drive surface engages the tubular bag material, the loop drive belt having a plurality of passages extending transversely through the loop drive belt from said drive surface;

at least one manifold to be subjected to a reduced air pressure and communicating with the passages for at least a part of said first path portion so that the passages are subjected to a reduced air pressure so that a difference in air pressure across the tubular bag material urges the tubular bag material against said drive surface;

a drive pulley engaged with the loop drive belt to cause the loop drive belt to move along said polygonal path in a predetermined direction;

a plurality of belt engaging devices, wherein said first path portion is defined as a linear section of said polygonal path that is disposed directly between a first one of the belt engaging devices on an upstream end of the first path portion, and said drive pulley on a downstream end of said first path portion, wherein an entirety of the first path portion is linear and configured and disposed to engage the tubular bag material, wherein the belt engaging devices cooperate with each other and with the drive pulley to provide a second path portion and a third path portion, with the second and third path portions cooperating with said linear first path portion to provide the polygonal path;

a backing bar located internally of the tubular bag material; and a heating bar at said first path portion urged toward the backing bar to engage the tubular bag material between the heating bar and backing bar to form the longitudinal seal.

2. The combination of claim 1, wherein said plurality of belt engaging devices further comprises a second belt engaging device.

3. The combination of claim 2, wherein the first and second belt engaging devices are pulleys.

4. The combination of claim 2, wherein the second and third path portions are linear.

5. The combination of claim 2, wherein said loop drive belt is a first loop drive belt, and said film drive assembly further comprises a second loop drive belt, the second loop drive belt being parallel to the first loop drive belt and including a second drive surface and a plurality of second passages extending transversely of the second loop drive belt from the second drive surface, with the second passages communicating with the manifold so that the second passages are subjected to the reduced air pressure to urge the tubular bag material into engagement with the second loop drive belt.

6. The combination of claim 5, wherein the second loop drive belt passes around the drive pulley, the first belt engaging device, and the second belt engaging device.

7. The combination of claim 6, wherein the drive pulley engages the first and second loop drive belts so the first and second loop drive belts are driven in unison.

8. The combination of claim 7, further comprising a heating bar at said first path portion to heat the tubular bag material and being urged into contact with the tubular bag material, the heating bar being located between the first and second loop drive belts.

9. The combination of claim 8, wherein said at least one manifold comprises a first manifold and a second manifold, the first manifold being operatively associated with the first loop drive belt to apply the reduced air pressure thereto, and said second manifold being operatively associated with said second loop drive belt to apply the reduced air pressure thereto.

10. The combination of claim 1, wherein the belt engaging devices are pulleys.

11. The combination of claim 1, wherein the second and third path portions are linear.

12. The combination of claim 11, wherein said loop drive belt is a first loop drive belt, and said film drive assembly further comprises a second loop drive belt, the second loop drive belt being parallel to the first loop drive belt and including a second drive surface and a plurality of second passages extending transversely of the second loop drive belt from the second drive surface, with the second passages communicating with the manifold so that the second passages are subjected to the reduced air pressure to urge the tubular bag material into engagement with the second loop drive belt, the second loop drive belt passes around the drive pulley and the belt engaging devices, the drive pulley engages the first and second loop drive belts so the first and second loop drive belts are driven in unison, and wherein the heating bar is located between the first and second loop drive belts, wherein said at least one manifold comprises a first manifold and a second manifold, the first manifold being operatively associated with the first loop drive belt to apply the reduced air pressure thereto, and said second manifold being operatively associated with said second loop drive belt to apply the reduced air pressure thereto.

13. The combination of claim 1, wherein said loop drive belt is a first loop drive belt, and said film drive assembly further comprises a second loop drive belt, the second loop drive belt being parallel to the first loop drive belt and including a second drive surface and a plurality of second passages extending transversely of the second loop drive belt from the second drive surface, with the second passages communicating with the manifold so that the second passages are subjected to the reduced air pressure to urge the tubular bag material into engagement with the second loop drive belt.

14. The combination of claim 13, wherein the second loop drive belt passes around the drive pulley and the belt engaging devices.

15. The combination of claim 13, wherein the drive pulley engages the first and second loop drive belts so the first and second loop drive belts are driven in unison.

16. The combination of claim 13, wherein the heating bar is located between the first and second loop drive belts.

17. The combination of claim 16, wherein said at least one manifold comprises a first manifold and a second manifold, the first manifold being operatively associated with the first loop drive belt to apply the reduced air pressure thereto, and said second manifold being operatively associated with said second loop drive belt to apply the reduced air pressure thereto.

* * * * *